US005338037A

United States Patent [19]

Toyohara

[11] Patent Number: 5,338,037

[45] Date of Patent: Aug. 16, 1994

[54] GOLF TRAINING APPARATUS

[76] Inventor: Hirohide Toyohara, 19-3, 3-chome, Chigusa, Takarazuka-shi, 665, Japan

[21] Appl. No.: 58,233

[22] Filed: May 10, 1993

[30] Foreign Application Priority Data

May 27, 1992 [JP] Japan ..... 4-162295

[51] Int. Cl.[5] ..... A63B 69/36

[52] U.S. Cl. ..... 273/187.6; 434/252

[58] Field of Search ..... 273/187.6, 190 R, 186.1, 273/186.3; 434/252

[56] References Cited

U.S. PATENT DOCUMENTS

| | | | |
|---|---|---|---|
| 3,866,907 | 2/1975 | Goudie et al. | 273/187.6 X |
| 4,340,229 | 7/1982 | Stuff | 273/187.6 X |
| 4,762,325 | 8/1988 | McCleery | 273/187.6 X |
| 4,796,892 | 1/1989 | Doerrfeld | 273/187.6 |
| 4,957,295 | 9/1990 | McConkey | 273/187.6 X |
| 5,211,400 | 5/1993 | Hall et al. | 273/187.6 |

*Primary Examiner*—George J. Marlo

*Attorney, Agent, or Firm*—Oblon, Spivak, McClelland, Maier & Neustadt

[57] ABSTRACT

A golf training apparatus for training a golf player to be skilled in the proper action of a swing at a golf ball on a ground surface, the apparatus comprising:

a sight fixing device including at least one of: (a) a pair of spaced apart lighting spots; and (b) a lighting arrow having spaced apart initial and terminal ends and a mechanism for maintaining said spots or ends spaced apart a predetermined distance in a horizontal plane at a predetermined height between the ground surface and the golfer's eye level which permits the user to sight on a golf ball on said surface with said pair of lighting spots or said ends of said lighting arrow while standing in a proper golf address position and at the top of a proper backswing.

17 Claims, 9 Drawing Sheets

FIG. 7A
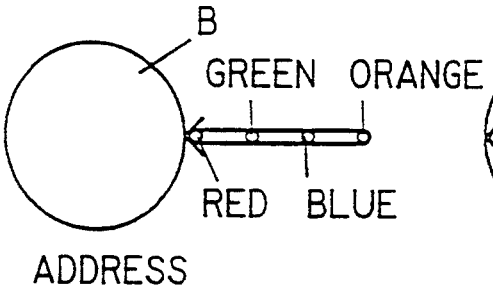
FIG. 7B
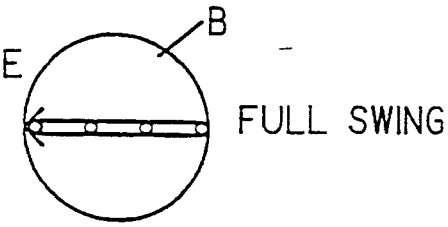
FIG. 7C
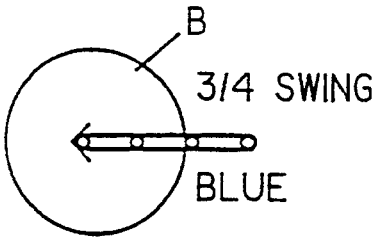
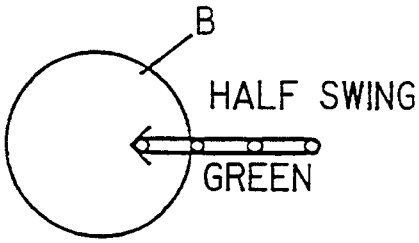
FIG. 7D
FIG. 7E
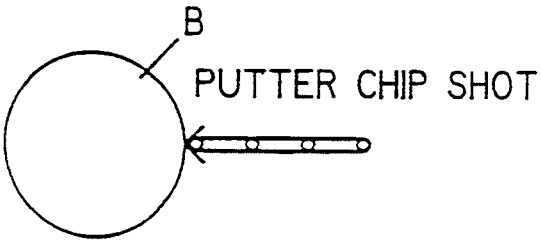

GOLF TRAINING APPARATUS

BACKGROUND OF THE INVENTION

The present invention relates to a golf training apparatus useful for swing practice at home and at an indoor or outdoor driving practice range.

There have so far been provided various golf training apparatus including those for correcting and stabilizing a swing form. For example, we know an apparatus having a large circular guide ring forming a correct swing plane. A golf trainee can get skilled in the proper form of swing by repeating the practice of swing along the guide ring.

However, we know no such training apparatus as contrived so as to make a golf trainee habituated to stabilize his or her eyes (head) in a certain definite direction at the two extreme positions of addressing and full take-back, especially at the position of take-back, in the process of a swing-back action, or an apparatus for training a golf trainee to move the eyes (head) so as to stably draw a definite locus between the above-mentioned two extreme positions. Further, there is not known an apparatus useful in habituate a right-handed (left-handed) golf player to use the left (right) eye at the position of full take-back.

If a golfer swings a club in an idealized manner, the swing has its swing axis kept through the back of the golfer's head, and the golfer naturally turns his head, and therefore eyes too, around the above swing axis. This holds true, of course, in the case of back swing, and the golfer's line of sight changes more or less during at least a relatively large swing-back action from addressing to full take-back. To achieve a proper swing action it is essentially important for a golfer to stabilize his or her line of sight at two extreme positions of addressing and full take-back in the process of a swing-back action and also to make the line of sight change stably between the above two extreme positions.

OBJECTS AND SUMMARY OF THE INVENTION

The present invention aims at resolving the contradiction between the above mentioned present state of training apparatus and the above briefed fundamentally important training to get skilled in the swing-back or take-back action, and makes it an object to provide a new golf training apparatus useful in making a golf trainee habituated to stabilize his or her eyes (head) in certain definite direction at the two extreme positions of addressing and full take-back in the process of the swing-back action.

Another object of the present invention is to add to the new golf training apparatus a function to make a golf trainee cultivate a habit of moving his eyes (head) so as to stably draw a definite locus between the two extreme positions in the process of the swing-back action.

A further object of the present invention is to provide the new golf training apparatus also with a further additional function to train a right-handed and a left-handed golf trainee to habitually use at the position of full take-back his or her left eye and right eye, respectively.

To achieve the above objects the golf training apparatus based on the present invention consists essentially of a ball aiming sight fixing means (hereinafter abbreviated as "sight fixing means") made up of a light emitting arrow (hereinafter abbreviated as "lighting arrow") or of a plurality of light emitting spots (hereinafter abbreviated as "lighting spots").

In a first embodiment of the present invention the sight fixing means comprises two lighting spots. The two lighting spots, whose distance from each other is made variable, are kept horizontal and have their height made adjustable between the golf trainee's eye level and the ground. In such a constitution of the sight fixing means, the height and interspot distance of the two lighting spots are adjusted so that both the lines of right-eye sight and left-eye sight of a golf trainee are directed respectively to the right and the left side of an objective ball through the right one and the left one of the lighting points respectively. With the two lighting spots, namely, the sight fixing means so adjusted, if the trainee is right-handed, his or her left-eye sight, in the addressing posture, aims at the right side (addressing side) of the ball through the left one of the two lighting spots. Then the trainee starts to swing back his or her golf club with the head turned right-handedly so that, when the swing-back action brings the club to the position of top-of-swing, the left-eye sight aims at the right side of the ball through the right one of the two lighting points. In the case of the trainee being left-handed, the above description holds true with the "right" and the "left" exchanged with each other.

According to a second embodiment of the present invention, the sight fixing means is constituted of a lighting arrow instead of the two lighting spots of the first embodiment. The terminal point and the initial point of the arrow positionally correspond respectively to the left one and the right one of the two lighting spots, and the arrow is kept horizontal between the trainee's eye level and the ground. The usage of this embodiment is substantially the same as that of the first embodiment and is easily understood from the previous description in consideration of the above-mentioned correspondency of both the ends of the lighting arrow with the two lighting spots.

As is briefed above with the first embodiment exemplified, the golf training apparatus according to the present invention is to help golf trainees get skilled in fixing their lines of sight properly and stably, and therefore, in taking a proper posture at the positions of addressing and full take-back in the process of back-swing.

Both of the above embodiments are modified with a plurality of supplemental lighting spots added between the two (main) lighting spots of the first embodiment and within the length of the arrow of the second embodiment. The supplemental lighting spots are to train for not full swings such as half swing and three-fourths swing.

The embodiments are further modified to give a third embodiment of the present invention by devising the supplemental lighting spots so as to emit light not at the same time but in time-series. This embodiment is useful in training for the timing and speed of the swing action. The light emitting timing and intervals of the supplemental lighting spots are purposefully controlled with an electronic circuit.

In all of the above embodiments and modifications, the lighting spots are of the cut end of either an optical fiber transmitting a light beam from a light source or an so called "photoluminescent fiber". The photoluminescent fiber, which contains photoluminescent materials, absorbs ambient light through its surface and gives forth light emission from its cut end, while the lighting arrow uses either a light guiding sheet or a photoluminescent sheet.

BRIEF DESCRIPTION OF THE DRAWINGS

The present invention is described in further detail in the following in reference to the accompanying drawing, in which:

FIGS. 7A–7D illustrate various positional relations between a golf ball and a sight fixing means, both seen by a trainee at the addressing and top-of-swing postures;

DETAILED DESCRIPTION OF THE INVENTION

Figure 1:
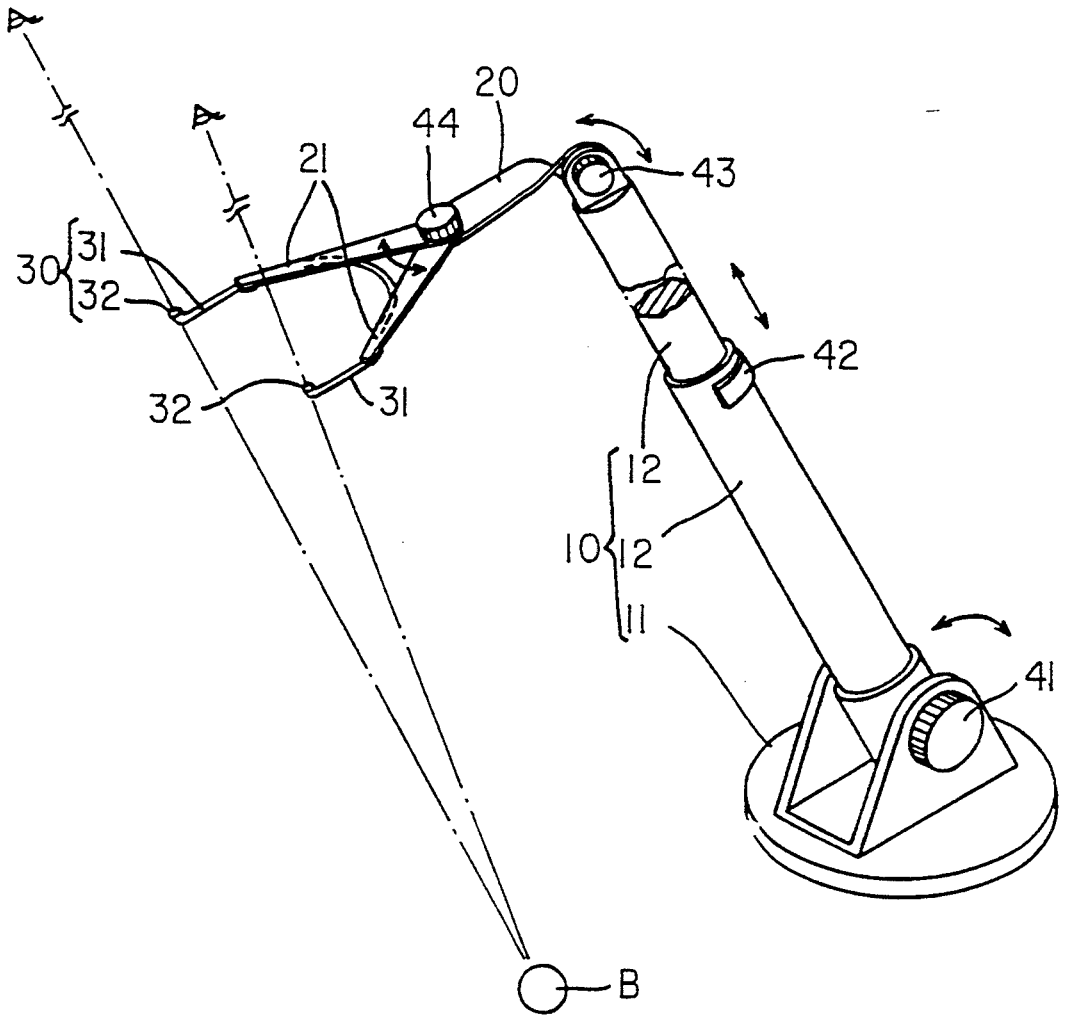
FIG. 1 is a perspective view showing the whole constitution of an embodiment of the present invention, including an example of sight fixing means.

Referring to FIG. 1, which shows the entire constitution of an embodiment of the present invention, a support 10, an arm 20 and a sight fixing means 30 constitute a golf training apparatus. The support 10 consists of a base 11 and a telescopic column 12 pivotally fixed to the base by means of an adjusting knob 41. The telescopic column 12 has its upper end made to pivotally support one end of the arm 20 through an adjusting knob 43. The other end of the arm 20 carries the sight fixing means 30 through a pair of connecting elements 21 supported pivotally by an adjusting knob 44. Thus the sight fixing means (consisting of two lighting spots 32) not only has its span made variable but also has its position made three-dimensionally variable. With the golf training apparatus thus constituted, the base 14 may be fixed directly to the ground or mounted on the framework of a ball supplying mechanism provided at a golf practice garden. The detailed constitution is not restricted to that shown in FIG. 1. Any modification is possible, if the sight fixing means has its position made three-dimensionally adjustable without getting in the way of swing action.

The sight fixing means 30 is made up of both the cut ends of a photoluminescent fiber 31, which is made of a flexible material. The photoluminescent fiber, as is briefed in the introductory part of this specification, contains a photo luminescent material therein, absorbs ambient light through its outer surface and gives forth light emission from its cut ends. Therefore, the lighting spots 32 by means of the photoluminescent fiber 31 are made up in a simple constitution, because they need no specially prepared light source, if the photoluminescent fiber 31 has a length enough to absorb a necessary quantity of light.

The size of the lighting spots 32 can optionally be varied by changing the thickness of the photoluminescent fiber 31. The shape of the lighting spots 32 can also be modified easily, not restricted to a circle, into various patterns such as a starry shape and others by changing the cross-sectional shape of the photoluminescent fiber 31. Further, the color of the spots are varied by changing the kind of the photoluminescent material(s) used or the mixing ratio of the materials. In the embodiment shown in FIG. 1, the two lighting spots 32 are made up of both the cut ends of one photoluminescent fiber 31, and therefore, they emit the same color of light. The two lighting spots can easily be made to emit different colors by constituting them on the cut ends of two different photoluminescent fibers.

The photoluminescent fiber 31, which is, as is briefed in the introductory part of the specification, made of a flexible material, must be elastic and springy, because the sight fixing means 30 is expected to be free from damage and to make a rapid recovery of its position and shape if mistakenly hit by a hard body such as a golf club.

In the following the usage of this golf training apparatus is described according to FIGS. 2 and 3. In the description, the trainee is supposed to be right-handed.

Figure 2:
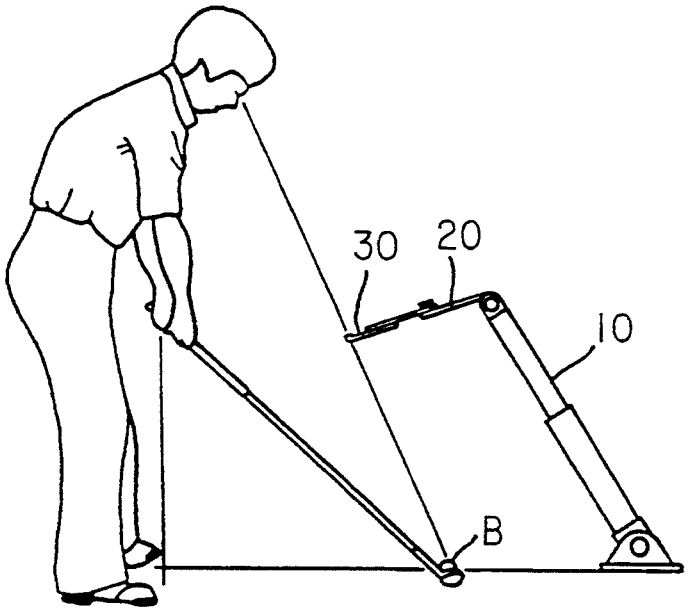
FIG. 2 shows a state of training by means of the golf training apparatus according to the present invention.
Figure 3:
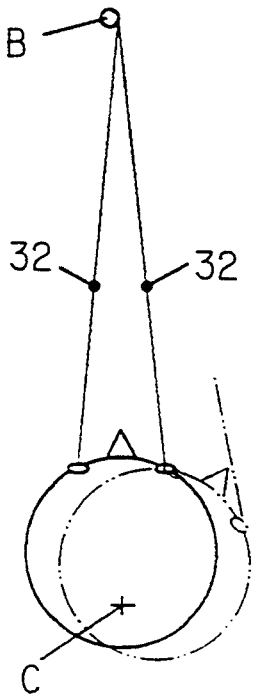
FIG. 3 shows another state of training by means of the golf training apparatus according to the present invention.

FIG. 2 shows a side view of the golf training apparatus and a trainee taking a proper addressing posture before the apparatus. The sight fixing apparatus 30 has its position adjusted so as to be penetrated by the trainee's lines of sight directed to a golf ball B, while FIG. 3 shows a simplified plan view corresponding to the side view shown in FIG. 2. In FIG. 3, the sight fixing apparatus is represented by the two lighting spots 32 which are the main constituents of the sight fixing means, and the trainee is shown by only his (or her) head. The distance between the two lighting spots 32 are preferably chosen to be 25 mm to 27 mm. In consideration of an averaged human inter-eye separation of 60 mm to 70 mm, this distance makes it possible for the trainee to see the ball B between the two lighting spots 32 in both the proper positions of addressing and top-of-swing. Between the two lighting spots 32 is positioned the ball B. With this addressing posture taken by the trainee, the left-eye sight is directed to the right side of the ball B through the left one of the two lighting spots 32. The trainee then starts swing-back action from the addressing position illustrated in FIGS. 2 and 3, turning the head clockwise around an axis C until the left-eye sight comes to be directed through the right one of the spots 32 to the ball B.

As is described above, the trainee can be thus trained by means of the two lighting spots 32 to properly direct the left-eye sight in both the positions of addressing and top-of-swing. Thus the right-handed trainee is habituated to see the ball B with the left eye. This is very desirable in making progress in the golf. If a right-handed player uses the right eye, the sight is interrupted by the nose, causing the player to be damaged in concentrating his or her attention on the ball. Many famous professional golfers suggest it is advantageous for a right-handed player to use the left eye.

In addition the stability of sight in the position of top-of-swing causes not only the player's head but also the club swung up to be stabilized. Further, the training with this training apparatus habituate the trainee to the proper movement of the trainee's neck and sight during the action of swing.

The present invention is based on the fact that, in the case of a skilled right-handed player, the direction of the left-eye sight in the position of top-of-swing coincides with the right-eye sight in the position of addressing.

The above description can be applicable to left-handed players by exchanging the "right" and "left" with each other.

Figure 4:
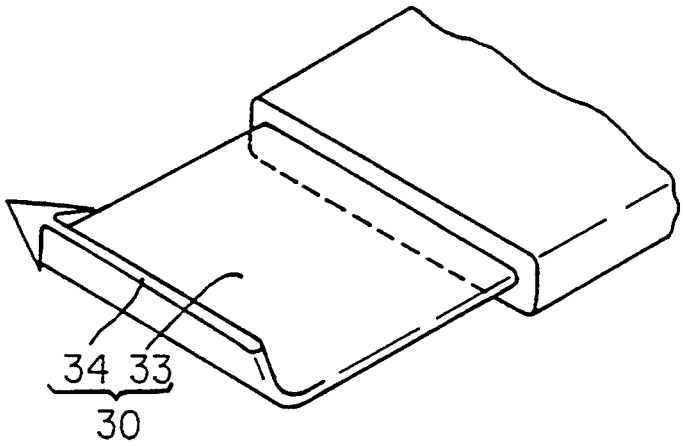
FIG. 4 shows another example of sight fixing means.
Figure 5:
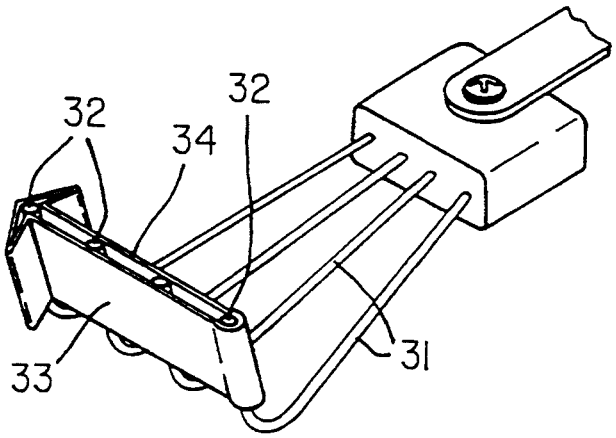
FIG. 5 shows a further example of sight fixing means.

In another embodiment of the present invention, the sight fixing means is made up of a lighting arrow 34 as shown in FIG. 4 or of a combination of a lighting arrow 34 and lighting spots 32 as shown in FIG. 5.

In FIG. 4 the lighting arrow 34 is formed at the arrow-shaped cut end of a photoluminescent sheet, which is made of a flexible material having enough elasticity as in the case of the photoluminescent fiber used in the previous embodiment. The constitution and effect of the photoluminescent "sheet" is the same as those of the photoluminescent "fiber".

In the case of the combination of the lighting arrow 34 and the lighting spots 32 as shown in FIG. 5, the lighting spots 32 are provided at least at both the terminal and the initial ends of the lighting arrow 34. Further, additional lighting spots are situated at suitable places within the arrow 34. The suitable places are locations where the line of sight in the position of top-of-swing penetrates in the case of not full swing such as half swing and three-fourths swing. The lighting arrow 34 and the lighting spots 32 light preferably in different colors.

Figure 6:
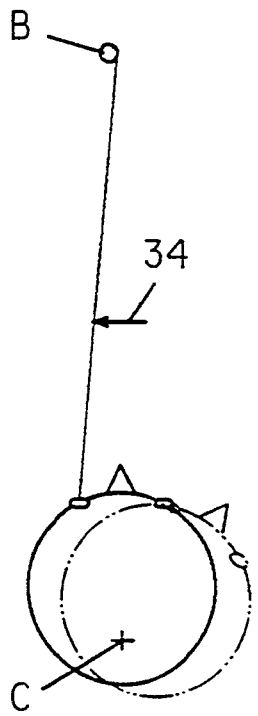
FIG. 6 shows a further state of training by means of the golf training apparatus according to the present invention.

The usage of this embodiment is described according to FIGS. 6 and 7. The present embodiment is essentially the same as the previous embodiment shown in FIG. 1, if it is taken into consideration that the terminal and the initial ends of the lighting arrow 34 correspond to the left one and the right one of the two lighting spots 32 of the embodiment shown in FIG. 1. Therefore, the usage also is essentially the same as in the case of the previous embodiment. However, the present embodiment makes it possible to practice half swing and three-fourths swing.

In the case of the practice being of full swing, first the height of the lighting arrow 34 is adjusted so as to coincide with the diameter of the ball B. The trainee then determines the position of addressing by making the left-eye sight directed, as is illustrated in FIG. 7(A), to the right side of the ball B through the terminal end of the lighting arrow 34. The action of swing-back is continued until the left-eye sight comes to be directed through the initial end of the arrow 34 to the right side of the ball B. At this stage the image of the lighting arrow 34 is completely overlapped with the image of the ball B, as is illustrated in FIG. 7(B).

Figure 8:
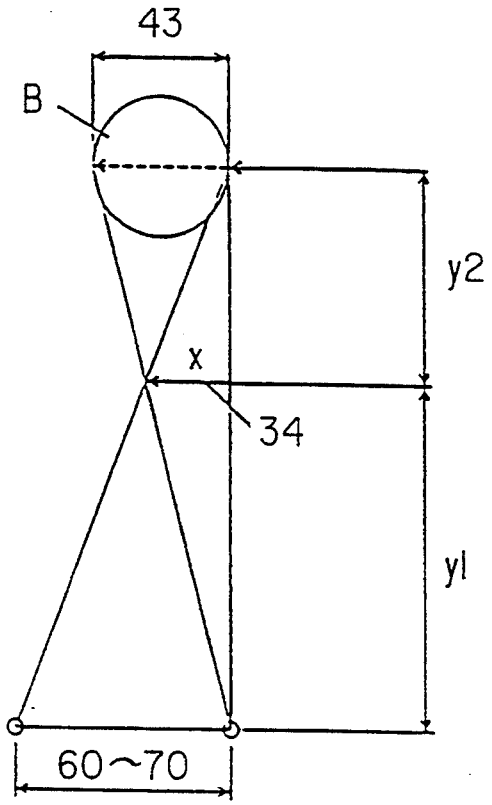
FIG. 8 gives a geometrical illustration for obtaining the suitable length of the sight fixing measure.

In order to satisfy this condition, the length of the lighting arrow 34 necessarily lies between 25 mm and 27 mm, if the diameter of the ball B is 43 mm and the human inter-eye separation is supposed to be 60 mm to 70 mm. This holds true also in the case of the sight fixing means consisting of two lighting spots. In the geometrical relation as shown in FIG. 8, the following simultaneous equations are obtained:

$$X/(60\sim70)=Y_2/(Y_1Y_2),$$

$$(60\sim70)/43=Y_1/Y_2,$$

where X is the length of the lighting arrow 34. These equation is solved with respect to X, giving $X=25.04\sim26.63$.

Figure 12:
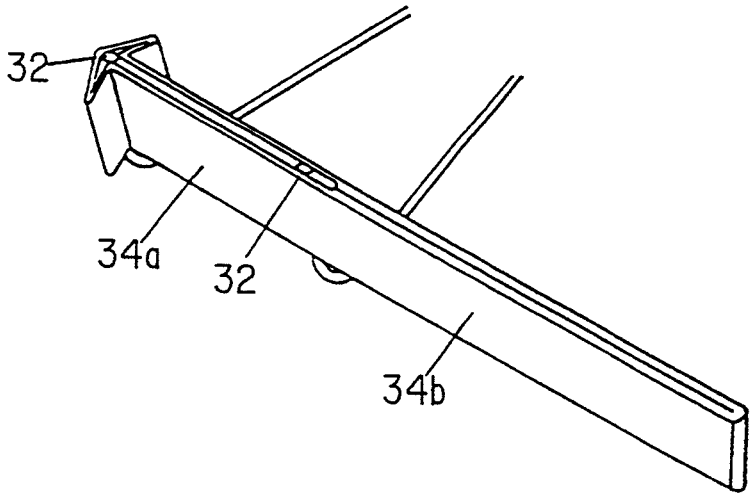
FIG. 12 shows a still further example of a sight fixing arrangement.

It is generally said that during the action of take-back the golf club is preferably taken back straight, within a distance of 300 mm from the addressing position, on the backward prolongation of a ball sending line. This initial straight position in the back-swing can easily be practiced with the so far described lighting-spot type or narrow-shaped sight fixing means modified by adding to it a minor guide part. In the case of an arrow-shaped sight fixing means, for instance, the arrow 34*a* having a pair of light spots 32 located respectively at its terminal end and 25~27 mm-distanced initial end is further provided, as shown in FIG. 12, with an extension part 34*b* which serves as a guide for the above-mentioned 300 mm-straight portion of the swing-back. The length of the extension part 34*b* is determined to be 180 mm to make the extension part 34*b* correspond to the above distance of 300 mm at a height where the 25~27 mm separation overlaps with the golf ball B of 43 mm. With the sight fixing means thus modified, a trainee first starts the straight 300 mm take-back action from the addressing position with the extension part 34*b* used as a guide, and then turns his or her head until the terminal end of the arrow comes to coincide with the left end of the ball B. Thus the trainee can exercise a series of the desirable action from the position of addressing to that of top-of-swing through the initial action in the process of take-back.

If the lighting spots 32 are combined with the lighting arrow 34, the spots 32 are made to light in the different colors of red, green, blue and orange in the direction from right to left as shown in FIG. 7, and the practice of three-fourths swing is made by turning the head until the left-eye sight comes to be directed through the blue spot to the right side of the ball B (FIG. 7(C)). In the case of half swing, the head is turned until the left-eye sight comes to aim at the right side of the ball B through the green spot (FIG. 7(D)). FIG. 7(E) shows that no remarkable back-swing as accompanied by the change of eye sight is made for the action of pattering or a chip shot.

Though in all of the above embodiments the lighting spots 32 are constituted of the cut ends of photoluminescent fibers, they can be made in the form of a combination of a optical fiber and a light source.

Figure 9:
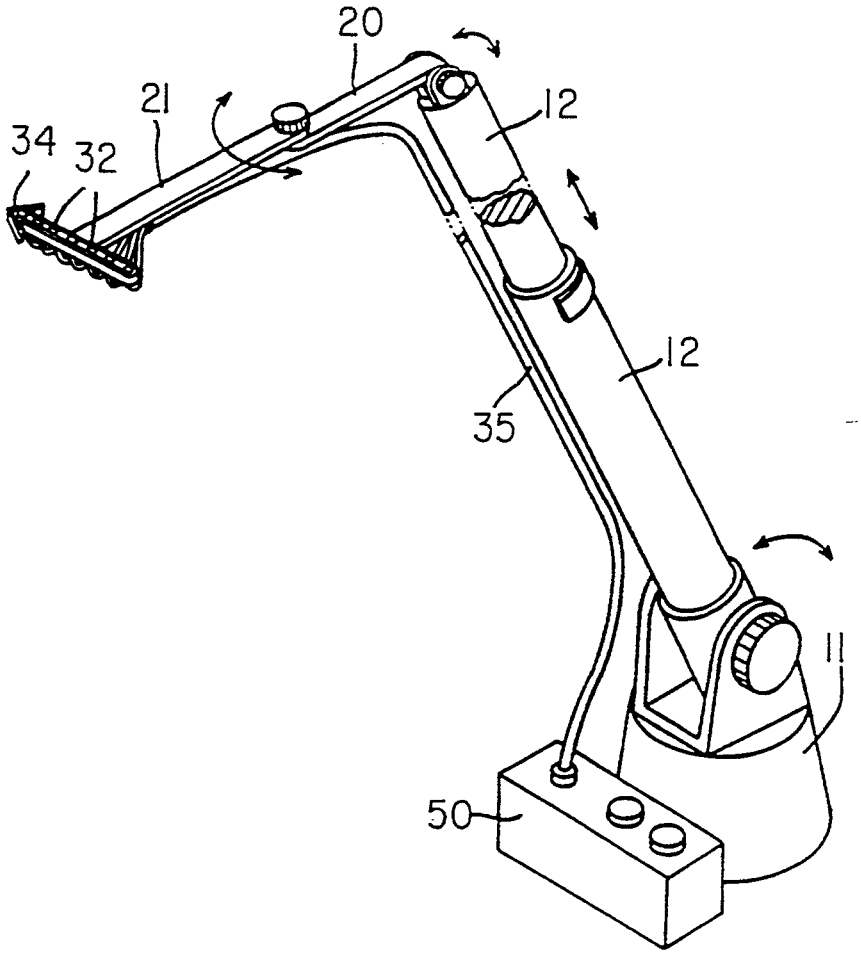
FIG. 9 is a perspective view showing the whole constitution of another embodiment of the present invention.
Figure 10:
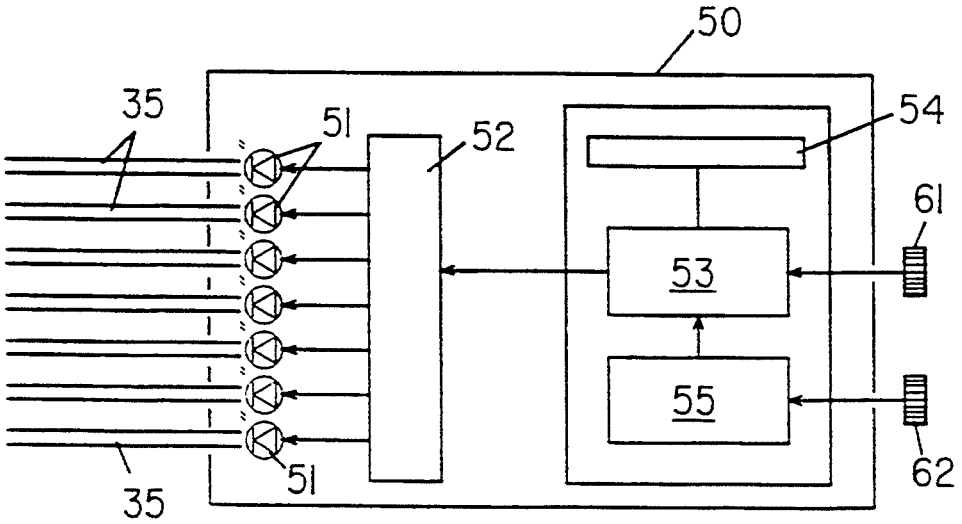
FIG. 10 shows a blockdiagrammatical illustration of a light source control circuit.
Figure 11A:
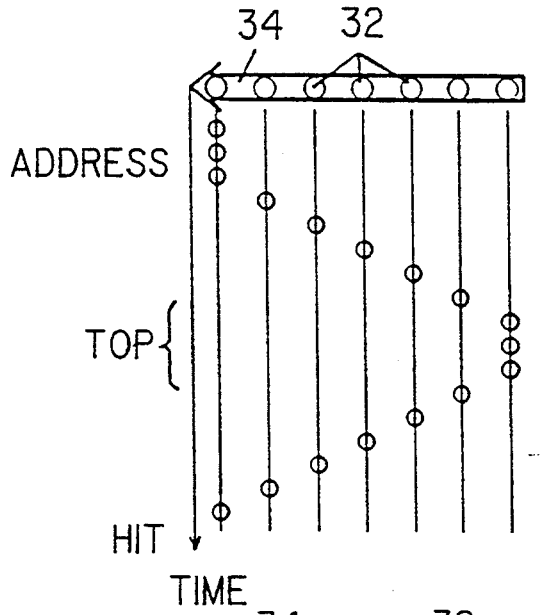
FIGS. 11A–11C illustrates the timing of turning on the light of lighting spots of the sight fixing measure, as classified by the kind of swing.
Figure 11B:
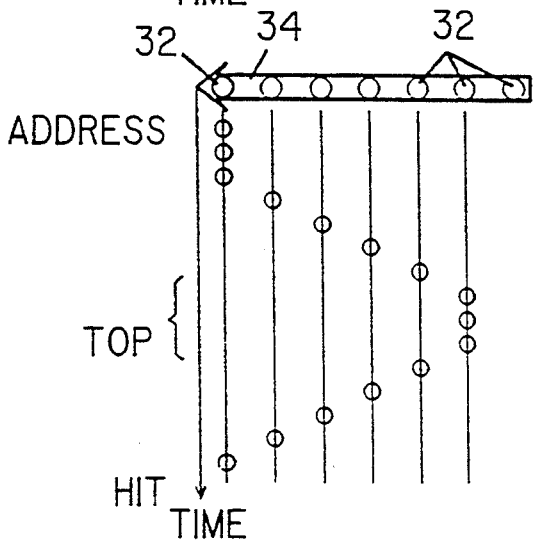
Figure 11C:
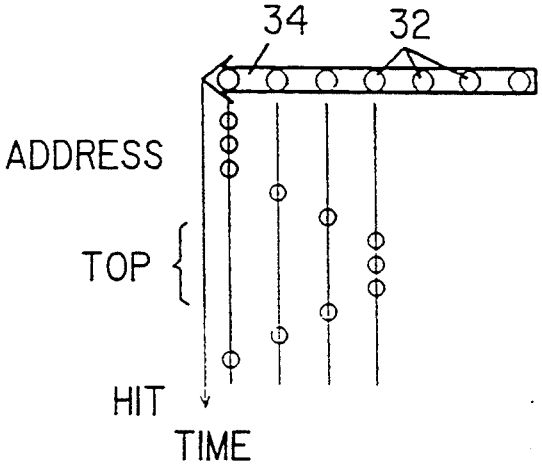

A further embodiment of the present invention is described in reference to FIGS. 9 to 11. Also in this embodiment the sight fixing means is made up of a lighting arrow 34 and a plurality of lighting spots 32 as in the case of the sight fixing means shown in FIG. 5. However, the lighting spots 32 are constituted of optical fibers 35 (FIG. 9). The optical fibers are light-supplied, as is shown in FIG. 10, from corresponding LEDs (light emitting diodes) 51. The LEDs 51 are turned on and off by a switching circuit 52 controlled by a timing control circuit 53. The timing control circuit 53 instructs the timing of switching the LEDs 51. The timing control circuit 53 is controlled by a switching mode storing memory 54 and a switching cycle control circuit 55. The LEDs 51 and the circuits 52 to 55 are encased in a housing 50. Outside the housing 50 there are provided a mode changing knob 61 and a switching cycle adjusting knob 62. Of the above entire circuit constitution, the circuits 53 to 55 can be computerized.

With the circuits thus constituted, the trainee selects a swing mode by the mode changing knob 61 in accordance with the swing mode to be practiced. The trainee further selects a switching cycle by the knob 62 according to the trainee's swing practice cycle. Thus the lighting spots 32 are lighted on and off at the timing adjusted so as to comply with the practicing condition determined by the trainee.

FIG. 11 shows the light emitting timing corresponding to the mode of the swing to be practiced. In the case of the full swing mode, the lighting spots 32 is turned on and off at the timing as shown in (A). In the case of the three-fourths swing mode, the timing schedule is shown in (B). The timing schedule for the half swing mode is shown in (C). The trainee can be habituated to proper swing actions and the proper movement of the line of sight.

This embodiment can be modified so that sound is generated each time the lighting spots emit light.

I claim:

1. A golf training apparatus for training a golf player to be skilled in the proper action of a swing at a golf ball on a ground surface, the apparatus comprising:

a sight fixing means including at least one of: (a) a pair of spaced apart lighting spots; and (b) a lighting arrow having a spaced apart initial and terminal ends; and a mechanism for maintaining said spots or ends spaced apart a predetermined distance in a horizontal plane at a predetermined height between the ground surface and the golfer's eye level which permits the user to sight on a golf ball on said surface with said pair of lighting spots or said ends of said lighting arrow while standing in a proper golf ball address position and at the top of a proper backswing.

2. The golf training apparatus of claim 1, wherein said sight fixing means consists essentially of said pair of spaced apart lighting spots.

3. The golf training apparatus of claim 1, wherein said sight fixing means consists of said lighting arrow.

4. The golf training apparatus of claim 1, wherein said sight fixing means includes both said pair of spaced apart lighting spots and said lighting arrow, said lighting arrow having a predetermined width, and said lighting spots being disposed within said predetermined width, and wherein said lighting arrow includes a length extending from said spaced apart initial and terminal ends, and further wherein said pair of lighting spots are spaced apart in a direction of said length.

5. The golf training apparatus of claims 2 or 4, wherein each of said lighting spots is formed of a cut end of a photoluminescent fiber.

6. The golf training apparatus of claims 2 or 4, wherein each of said lighting spots is formed of a cut end of an optical fiber, with said optical fiber transmitting light to said cut end from a light source.

7. The golf training apparatus of claims 3 or 4, wherein said lighting arrow is formed of a cut end of a photoluminescent sheet.

8. The golf training apparatus of claims 3 or 4, wherein said lighting arrow is formed of a cut end of an optical sheet, with said optical sheet transmitting light to said cut end from a light source.

9. The golf training apparatus of claim 1, wherein said sight fixing means consists essentially of a combination of said lighting arrow and a plurality of said lighting spots, said lighting arrow having a predetermined width, and said pair of lighting spots being arranged within said predetermined width of said lighting arrow along a length direction of said lighting arrow and being formed of cut ends of optical fiber which transmit light from light sources;

the golf training apparatus further including an electronic circuit for controlling said light sources in accordance with a mode of swing selected by said golf player.

10. The golf training apparatus of claim 9, wherein said lighting arrow is formed of a cut end of a photoluminescent sheet.

11. The golf training apparatus of claim 9, wherein said lighting arrow is formed of a cut end of a sheet-shaped optical guide transmitting light to said cut end from a light source.

12. The golf training apparatus of claim 1, wherein said sight fixing means comprises said pair of spaced apart lighting spots.

13. The golf training apparatus of claim 12, wherein said pair of lighting spots have different colored lights.

14. The golf training apparatus of claim 1, wherein said sight fixing means comprises said lighting arrow.

15. The golf training apparatus of claim 1, wherein said sight fixing means includes both said pair of lighting spots and said lighting arrow.

16. The golf training apparatus of claim 15, wherein said lighting spots and said lighting arrow have different colored lights.

17. The golf training apparatus of claim 1, wherein said sight fixing means includes at least one of: (a) an optical fiber; (b) a photoluminescent fiber; and (c) a photoluminescent sheet.

* * * * *